US011073369B2

(12) United States Patent
Paulic et al.

(10) Patent No.: US 11,073,369 B2
(45) Date of Patent: Jul. 27, 2021

(54) ELECTRONIC SAFE ARM AND FIRE DEVICE AND METHOD

(71) Applicant: Advanced Acoustic Concepts, LLC, Washington, DC (US)

(72) Inventors: Antonio Paulic, Westerville, OH (US); Benjamin Gary Conaway, Gaithersburg, MD (US); John Walter Rapp, Manassas, VA (US); John Granier, Round Rock, TX (US)

(73) Assignee: Advanced Acoustic Concepts, LLC, Hauppauge, NY (US)

( * ) Notice: Subject to any disclaimer, the term of this patent is extended or adjusted under 35 U.S.C. 154(b) by 0 days.

(21) Appl. No.: 16/732,659

(22) Filed: Jan. 2, 2020

(65) Prior Publication Data

US 2020/0208952 A1 Jul. 2, 2020

Related U.S. Application Data

(60) Provisional application No. 62/787,586, filed on Jan. 2, 2019.

(51) Int. Cl.
*F42C 15/40* (2006.01)
*B63G 8/28* (2006.01)
(Continued)

(52) U.S. Cl.
CPC ..... *F42C 15/40* (2013.01); *B63G 8/001* (2013.01); *B63G 8/28* (2013.01); *F42B 19/00* (2013.01); *B63G 2008/002* (2013.01)

(58) Field of Classification Search
CPC ..... F42B 19/00; F42B 15/22; F42B 15/20; F42B 12/00; F42B 12/02; F42B 12/20;
(Continued)

(56) References Cited

U.S. PATENT DOCUMENTS 4,372,239 A * 2/1983 Hagelberg ..... F42B 17/00 114/20.2
2003/0167956 A1* 9/2003 Kellner ..... F42B 12/208 102/517

(Continued)

*Primary Examiner* — Jonathan C Weber
(74) *Attorney, Agent, or Firm* — Kaplan Breyer Schwarz, LLP

(57) ABSTRACT

An article comprising an electronic safe-arm and fire (ESAF) device for a supercavitating cargo round (SCR) includes discrete electronics, a high-voltage capacitor, a high-voltage switch, and an exploding foil initiator. The discrete electronics includes digital-delay timer circuits, discrete logic circuits, accelerometers, and circuitry for enabling the high-voltage switch. In a method for implementing the safe and arm protocols, sensor readings from sensors on a weaponized UUV are obtained and, when certain conditions are achieved, remove inhibit signals are forwarded to a controller onboard the UUV. When such signals are received in a specified order, and within certain optional specified time delays, the controller arms the ESAF within the SCR. After the SCR fire and leaves the barrel on the UUV, the ESAF monitors certain acceleration/deceleration conditions unique to supercavitation, and applies same to determine whether to detonate the SCR's energetic payload.

10 Claims, 9 Drawing Sheets

(51) Int. Cl.
*B63G 8/00* (2006.01)
*F42B 19/00* (2006.01)

(58) Field of Classification Search
CPC ..... F42C 11/00; F42C 7/00; F42C 11/001; F42C 15/00; F42C 15/24; F42C 15/26; B63G 8/001; B63G 2008/002; B63G 8/28
USPC ..... 102/399, 247, 248, 249
See application file for complete search history.

(56) References Cited

U.S. PATENT DOCUMENTS

2011/0004367 A1* 1/2011 Saunders ..... B63B 3/04 701/23
2012/0240805 A1* 9/2012 Kautzsch ..... F42C 15/24 102/215

* cited by examiner

ELECTRONIC SAFE ARM AND FIRE DEVICE AND METHOD

This specification claims priority of U.S. Pat. App. Ser. No. 62/787,586, filed Jan. 2, 2019, and which is incorporated by reference herein.

FIELD OF THE INVENTION

The present invention relates to electronic safe and arm systems.

BACKGROUND

An electronic safe arm and fire (ESAF) device is a fuze component that safely arms and triggers a munition. The ESAF prevents a munition from arming during shipping, handling, and storage. It ensures that the certain conditions are met before a munition can arm or trigger.

The Federal Government establishes specific design safety criteria for fuzes in MIL-STD-1316F. The standard specifies that a fuzing system must include at least two independent safety features, each capable of preventing unintentional arming. The stimuli that enable these independent safety features to operate must derive from different environments. Furthermore, operation of at least one of the independent safety features must be based on sensing an environment after first motion in the launch cycle, or on sensing a post-launch environment.

Satisfying these requirements can be challenging as a function of munition specifics. For example, if the munition is small, cargo space is at a premium. Consequently, it may be quite problematic to fit the ESAF device and supporting electronics, such as sensors for sensing the environment and control electronics, on board the munition.

SUMMARY

The invention provides an ESAF device and methods therefor suitable for use with small rounds carrying energetic payloads.

In the illustrative embodiment, the ESAF device is used in conjunction with an underwater round, such as is fired from an underwater weapon. In some embodiments, the underwater weapon is an unmanned underwater vehicle (UUV) that includes an underwater gun capable of launching the underwater round.

In the illustrative embodiment, the underwater round attains very high speeds via a technique known as "supercavitation," wherein the round moves through a bubble of water vapor. Existing/proposed supercavitating munitions (with the exception of torpedoes) are kinetic projectiles. That is, they do not contain energetic material. Among any other reasons for this, the presence of energetic material would require the presence of a safe and arm device. And the design challenges of incorporating an ESAF device into a small supercavitating round are significant.

Very difficult to design as even a kinetic projectile, a supercavitating "cargo" round (the "cargo" comprising energetic material) has been developed by applicant. In some embodiments, the supercavitating cargo round ("SCR") is about 20 millimeters (mm) in diameter and has a length of about 300 mm. An ESAF was developed for this SCR and is also part of its "cargo." The same design and methodology can be used for larger SCRs. Furthermore, many of the same design features, and method of operation, can be used for SCRs that are fired from a stationary underwater weapon.

To address the challenge of implementing an ESAF device in a SCR, particularly one as small as mentioned above, ESAF electronics are shared between the weapons platform—in the illustrative embodiment, the UUV—and the SCR. The applicant realized that sensors aboard the UUV—present for reasons independent of verifying SCR arming conditions—could advantageously be used for that purpose. These sensors include, for example and without limitation, conductivity, sonar, video, GPS, altimeter, pressure, depth. Using UUV-sited ("onboard") sensors dispensed with the need to miniaturize sensors for the SCR. Moreover, using onboard sensors creates an ability to sense more conditions than would otherwise be possible if the sensors were installed in the SCR because (i) there isn't room for that many sensors in such a small round, and (ii) it is not even possible, currently, to miniaturize some of the aforementioned sensors to the extent required. A controller, also located on the UUV, is in communication with the sensors.

As noted above, MIL-STD-1316F requires a minimum of two independent safety features, each capable of preventing arming. By virtue of the aforementioned distributed layout, some ESAF designs in accordance with the present teachings include four independent safety features (i.e., inhibit signals) that further reduce the statistical probability of unintentional arming. And some further embodiments of ESAF designs in accordance with the present teachings include six independent safety features, which include the four mentioned above, plus another two relating to conditions occurring after the SCR is fired.

With respect to the arming conditions referenced above, as implemented by the distributed approach to ESAF electronics:

- In some embodiments, all arming conditions occur before the SCR is fired. In some other embodiments, some arming conditions occur before the SCR is fired, and some occur post firing.
- In some embodiments, all arming conditions are based on the environment of the SCR. In some other embodiments, some arming conditions are based on the SCR's environment, and some other arming conditions are based on a state of the SCR.
- In some embodiments, arming conditions are sensed by sensors that are not SCR based. In some other embodiments, some arming conditions are based on sensors that are not SCR based, whereas some other arming conditions are based on SCR-based sensors.
- In some embodiments, all arming conditions are based on conditions outside of the barrel of the weapon that fires the SCR. In some other embodiments, some arming conditions are based on conditions outside the barrel of the weapon, and some other arming conditions are based on conditions within the barrel of the weapon.

In some embodiments, conditions unique to supercavitating transit are used to assess the status of the fired round and, optionally, are a basis for not triggering the energetic payload of the SCR.

The present distributed approach for implementing ESAF electronics requires an electrical interface between the onboard controller and the SCR. However implemented, the electrical interface must: (i) not impede movement of the SCR, (ii) withstand the very high pressure and temperature within the barrel after firing, (iii) ensure that burning propellant gasses do not to pass from the barrel into the UUV, and (iv) withstand high-pressure water ram forces, as the water enters the barrel after firing, ensuring that no water enters the UUV.

The electrical interface proved very difficult to implement in light of these constraints. Indeed, many initial architectures failed due to the problem of electrical shorting that occurred as the SCR fired and the wired electrical connection to the onboard controller was severed. This problem was eventually solved via an arrangement comprising a cable mandrel with integrated spring contacts that is temporarily coupled to the tail of the SCR and which separates on firing.

DETAILED DESCRIPTION

The illustrative embodiment of the invention is an electronic safe and arm package for use with a supercavitating cargo round fired from a weaponized unmanned, underwater vehicle ("UUV"). The supercavitating cargo round, itself novel, includes an energetic material, such as a high explosive (e.g., PBXN-5, etc.), an incendiary material (e.g., thermite, etc.), a reactive composition (e.g., thermite-like pyrotechnic compositions of two or more nonexplosive solid materials that remain inert and do not react with one another until subjected to a sufficiently strong stimulus, etc.), or the like.

Figures 1, 2:
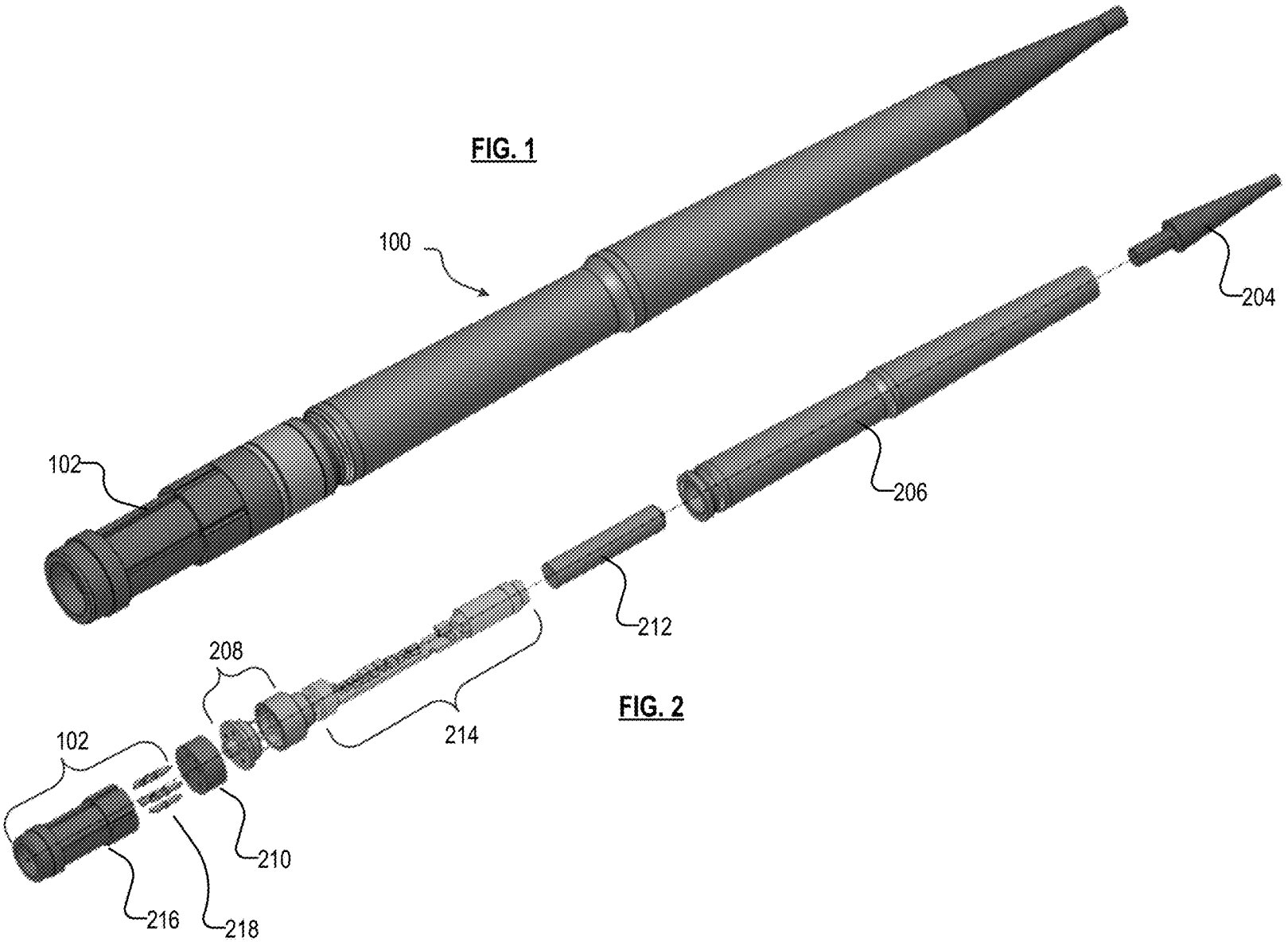
FIG. 1 depicts a perspective view of a supercavitating cargo round in accordance with the present teachings.
FIG. 2 depicts an exploded view of the supercavitating cargo round of FIG. 1.
Figure 11:
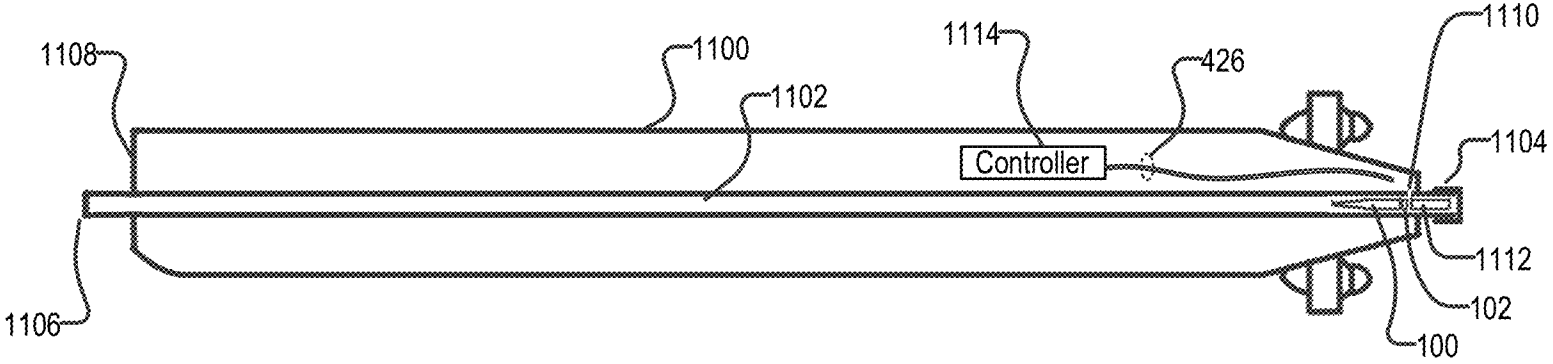
FIG. 11 depicts a weaponized UUV for firing a supercavitating cargo round, such as can be used in conjunction with the illustrative embodiment of the invention.

FIG. 1 depicts supercavitating cargo round (SCR) 100 and external electrical interface 102. As described in further detail later in this specification, external electrical interface 102 electrically couples SCR 100 to electronics onboard a weaponized UUV that is capable of firing the SCR. FIG. 11 depicts UUV 1100, which is an embodiment of such a weaponized UUV. The salient features of UUV 1100 depicted in FIG. 11 includes sensor suite 1108, controller 1114, and weapon barrel 1102 having breech 1104 and muzzle 1106. SCR 100 is depicted within breech 1104 of barrel 1102. The various features depicted in FIG. 11 will be discussed in further detail later this description, in context.

As depicted in the "exploded" view of FIG. 2, the salient, externally visible elements of SCR 100 include nose penetrator 204, body 206, cap 208, and cap insulator 210. Nose penetrator 204 comprises a very hard material, such as a heavy tungsten alloy. In the illustrative embodiment, body 206 comprises high-strength steel.

Cap 208, which in the illustrative embodiment comprises titanium and is implemented as two pieces, seals the aft end of body 206. Contained within body 206 are both an energetic payload 212 and an electronic payload 214. In the illustrative embodiment, energetic payload 212 is high explosive, such as PBXN-5. Cap insulator 210 comprises a material that is not electrically conductive, such as polyether ether ketone (PEEK).

External electrical interface 102 includes cable mandrel 216, and a plurality of electrical spring contacts 218 that are disposed in the cable mandrel. The spring-pin contacts are commercially available from Mill-Max Mfg. Corp. of Oyster Bay, N.Y. and others.

External electrical interface 102 is not physically attached to SCR 100; rather, it abuts the SCR. Before firing, the SCR, external electrical interface 102, and a propellant-containing cartridge (not depicted) are loaded into the barrel of the weapon. External electrical interface 102 is received by a counterbore hole in the barrel, and the cartridge is situated aft thereof. When the breech cap is closed, the cartridge is forced against the aft end of the external electrical interface 102. This forces external electrical interface 102 forward such that the pins of thereof (electrical spring contacts 218) are biased against cap insulator 210, to which it electrically couples. Upon firing, external electrical interface 102 remains in the barrel and the electrical connection between SCR 100 and onboard electronics is severed.

Figure 3:
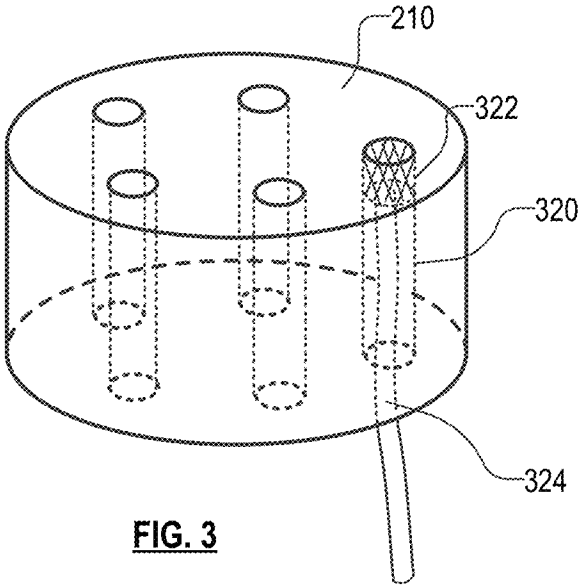
FIG. 3 depicts a cap insulator that used in conjunction with the illustrative embodiment.

More particularly, and with reference to FIG. 3, the pins of electrical spring contacts 218 physically engage electrically conductive contact pads 322 of cap insulator 210. In the illustrative embodiment, cap insulator 210 comprises five vias 320. The end of each via 320 nearest the surface of the cap insulator that faces external electrical interface 102 is coated with an electrically conductive material, such as copper, to form contact pads 322. Wire 324 is disposed in each via 324, and is electrically connected (e.g., soldered, etc.) to an associated contact pad 322. As discussed in further detail later herein, these wires electrically couple to the safe and arm electronics in SCR 100.

Figure 4:
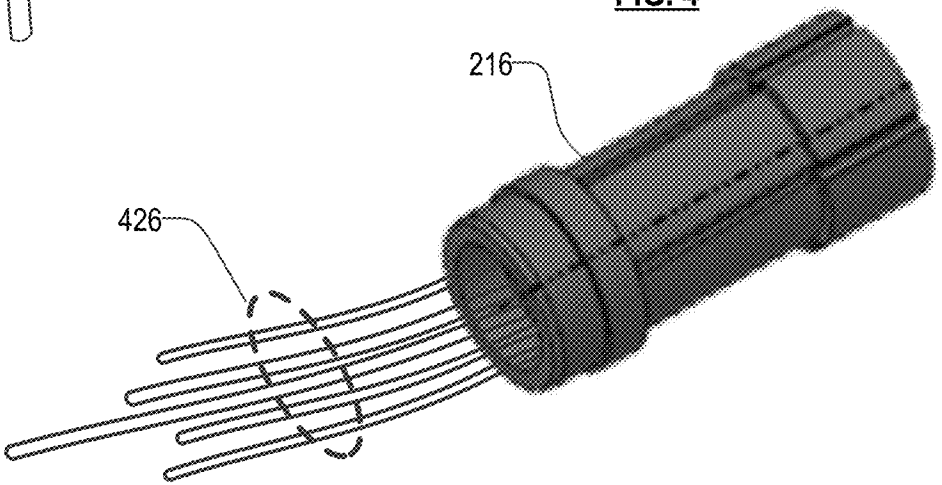
FIG. 4 depicts a cable mandrel for use in conjunction with the illustrative embodiment.

FIG. 4 depicts further detail of cable mandrel 216 of external electrical interface 102, showing signal wires 426 entering the aft end thereof. Wires 426 are electrically coupled to spring contacts 218 (not depicted in FIG. 4). Wires 426 are ultimately connected to a controller (see FIGS. 8,10, 11) located on the UUV. In some embodiments, wires 426 pass through opening 1110 in barrel 1102. (See, FIG. 11; showing SCR 100, external electrical interface 102, and propellant cartridge 1112 shown separated for clarity, and wires 426 shown not fully extending to external electrical interface 102 for clarity.) In some other embodiments (not depicted), wires 426 enter barrel 1102 further aft, and pass through propellant cartridge 1112 and then to external electrical interface 102. In this fashion, external electrical interface 102 enables electrical signals to be passed between the UUV electronics, such as the controller, that are located outside the barrel of the weapon, and SCR 100, which is located within the barrel.

Figures 5A, 5B:
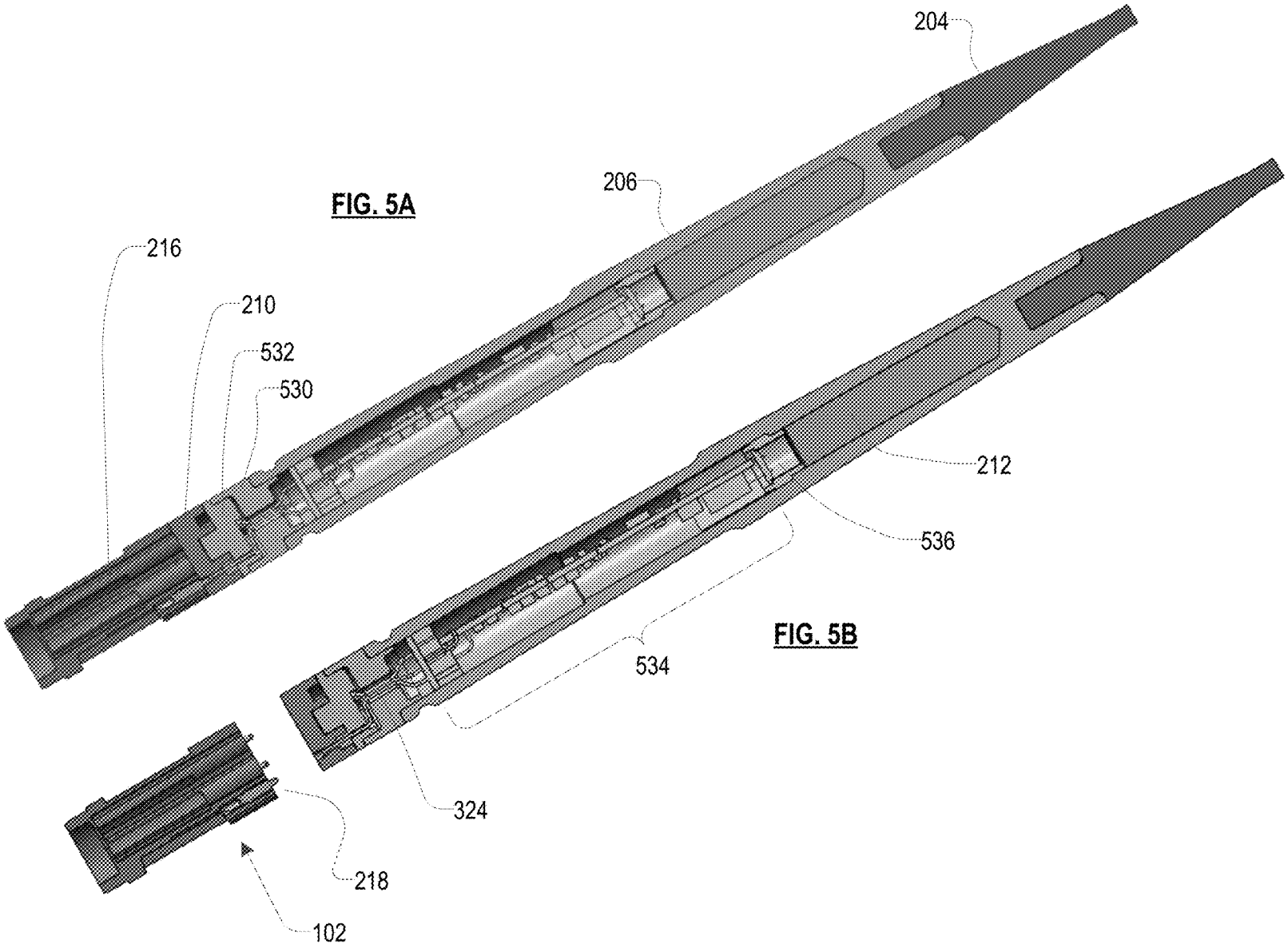
FIG. 5A depicts a cross-sectional view of the supercavitating cargo round of FIG. 1.
FIG. 5B depicts the cross-sectional view of the supercavitating cargo round of FIG. 5A, wherein a cable mandrel that is used in conjunction with the illustrative embodiment has detached upon firing of the round.

FIGS. 5A and 5B depict cross sectional views of the SCR 100 and external electrical interface 102. In FIG. 5A, the external electrical interface abuts SCR 100, such as when loaded in the barrel of the UUV's weapon. In FIG. 5B, these two elements are shown separated, such as after the SCR 100 has fired.

FIGS. 5A and 5B provide further detail of electronic payload 214, which in the illustrative embodiment, includes electronic safe-arm and fire ("ESAF") 534 and explosive foil initiator ("EFI") 536.

ESAF 534 is a device that prevents the SCR 100 from arming except under certain conditions, and, once those conditions are met, it arms and triggers the SCR. ESAF 534 must survive high-stress accelerations and rapid, sharp movements ("jerks"). These constraints eliminate commercially manufactured ESAF devices. For example, the "commercial rated" integrated-circuit packaging (i.e., the pins, case and wires that electro-mechanically isolate the silicon device inside) would fail during terminal ballistic impact or during acceleration through the barrel of the gun from which SCR 100 is fired. Consequently, ESAF 534 must be designed using a few select discrete circuit components. These circuits must be protected from possible failure due to electrostatic discharges. To ensure the safety provided by the logic of those ESAF circuits, safety resistors and circuits must be designed in as well. Additionally, SCR 100 has a diameter of about 20 mm, and the available space is extremely limited. ESAF 534 is discussed in further detail in conjunction with FIGS. 7-10.

Figure 6:
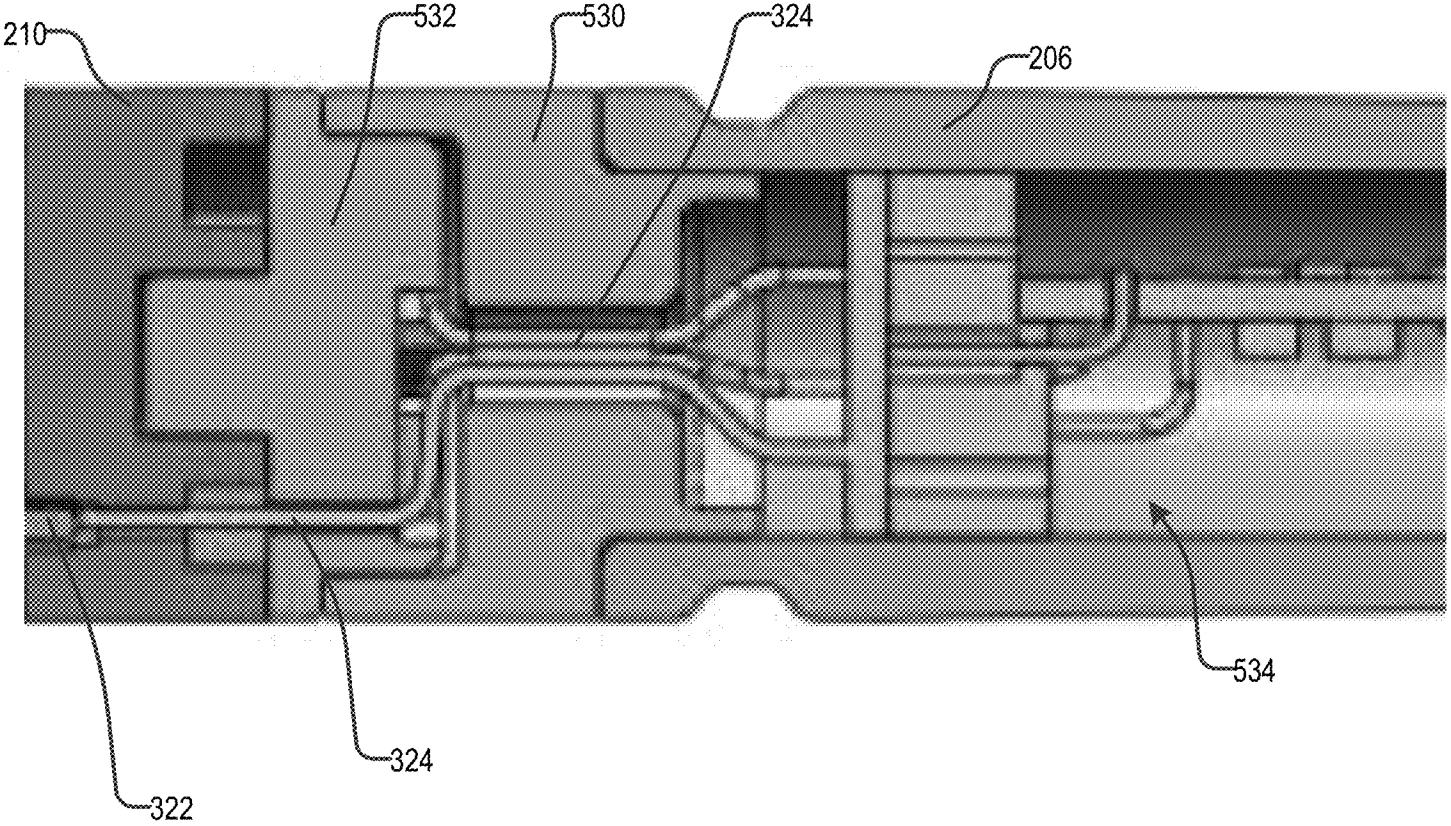
FIG. 6 depicts a cross-sectional view of the cap insulator and first and second caps of the supercavitating cargo round of FIG. 1, showing electrical connectivity from the cap insulator to an electronic safe arm and fire (ESAF) device.

With continuing reference to FIGS. 5A and 5B, and referring now to FIG. 6, electrical signals are relayed in the following manner from external electrical interface 102 to ESAF 534. As previously discussed, the pins of electrical spring contacts 218 of the external electrical interface physically engage electrically conductive contact pads 322 of cap insulator 210 when loaded in the breech of the barrel. Contact pads 322 are connected to signal wires 324. The signal wires pass through second cap portion 532 and first cap portion 530 of cap 208, and are electrically connected to ESAF 534.

When the appropriate conditions occur for initiating energetic payload 212, EFI 536 receives a high-voltage pulse from ESAF 534. The EFI provides the energy and shock needed to detonate relatively insensitive secondary explosives, such as energetic payload 212. Typically, an electrical stimulus in excess of 500 volts is required to actuate an EFI.

Figure 7:
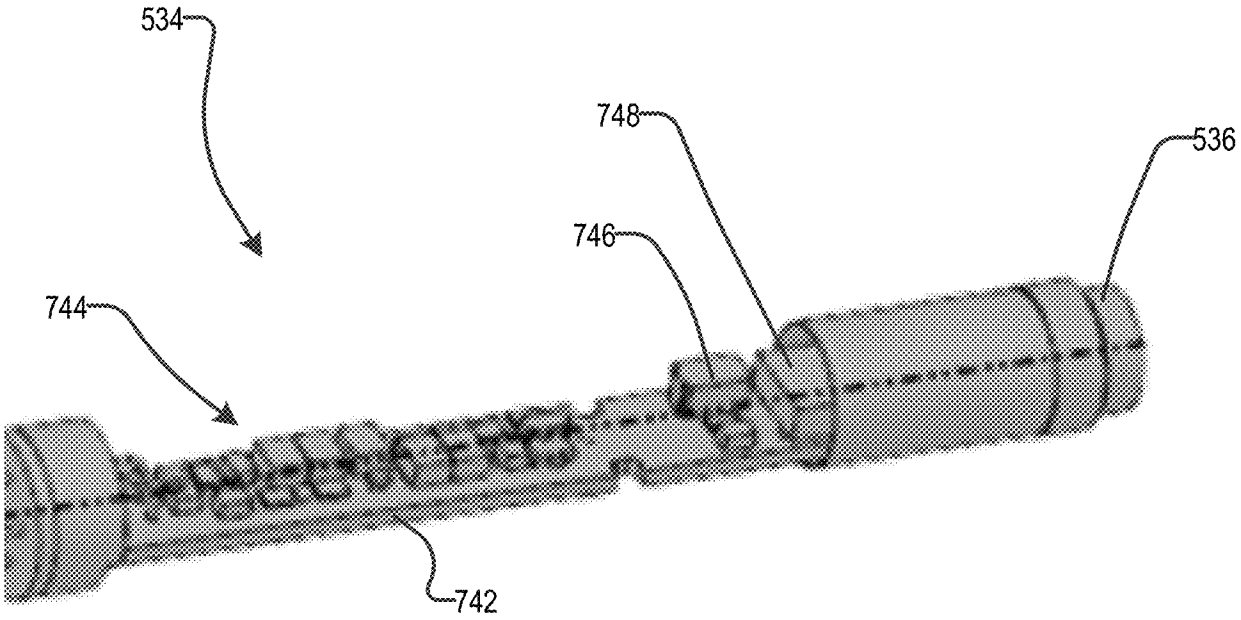
FIG. 7 depicts an ESAF device, configured for use in conjunction with the supercavitating cargo round of FIG. 1.

FIG. 7 depicts further detail of ESAF 534. The ESAF includes circuit board 742, upon which are discrete electronics and safety resistors 744, high-voltage (HV) capacitor 746, and HV switch 748. EFI 536 is also coupled to circuit board 742. Discrete electronics includes circuitry for enabling HV switch 748, digital-delay timer circuits, discrete logic circuits, and accelerometers (including at least two g-switches).

SCR 100 arms when HV capacitor 746 becomes charged. In the illustrative embodiment, as a condition precedent to arming/charging, four "inhibit" signals must be lifted. The default state of the inhibit must be safe and prevent accidental arming of SCR 100. To lift the inhibit signals, certain conditions pertaining to the pre-firing environment of SCR 100 must be satisfied. In accordance with the illustrative embodiment, these environmental conditions are sensed by electronics onboard the UUV, but external to SCR 100 and the gun barrel in which it resides.

Figure 8:
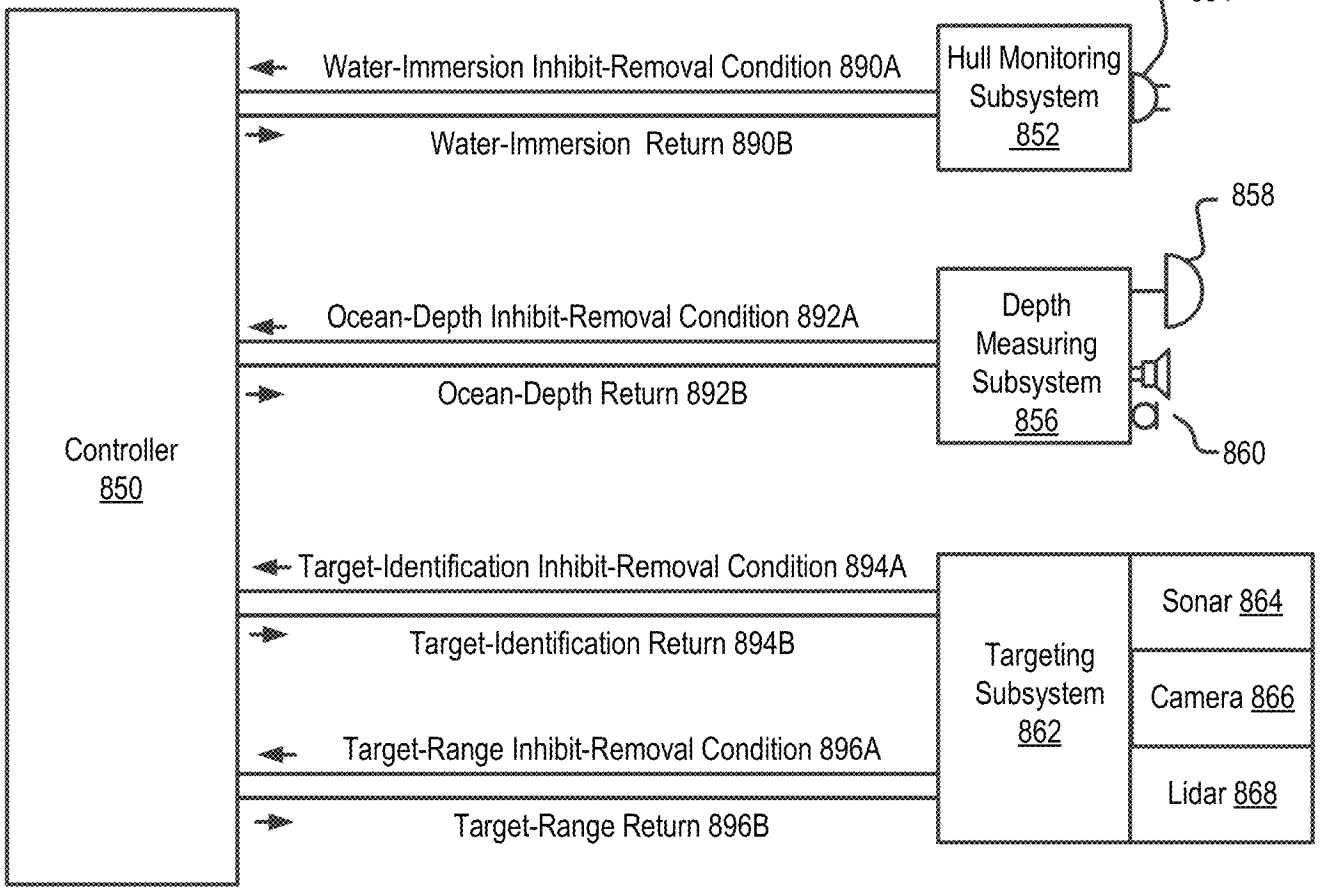
FIG. 8 depicts the use of sensor systems as discrete circuit interfaces to the controller for establishing that certain conditions have been met in support of safe and arm logic.

Referring now to FIG. 8, controller 850, which is onboard the UUV, receives sensor information that is ultimately responsible for lifting the four inhibit signals. A signaling circuit for each inhibit is in communication with the controller. A signal from the signaling circuit indicates that a condition has been met, such that a particular one of the inhibit signals can be removed.

As depicted in FIG. 8, controller 850 receives a total four inhibit-remove conditions (signals) from various subsystems of the weaponized UUV. In this embodiment, prior to arming SCR 100, the following four conditions must be satisfied:

(i) the weaponized UUV must be immersed in seawater;
(ii) the weaponized UUV must attain a specified ocean depth;
(iii) the weaponized UUV must have positively identified a target; and
(iv) the weaponized UUV must be within a specified range of the target.

Sensing systems for sensing conditions (i)-(iv), which are a part of sensor suite 1108 of UUV 1100, include: the uuv's hull monitoring subsystem 852, depth-measuring subsystem 856, and targeting subsystem 862. These sensing systems, which are nominally present on the UUV for other mission-related purposes, are advantageously used for sensing the aforementioned (or other) conditions, and communicate via discrete interfaces to the controller, as depicted in FIG. 8. The use of such discrete circuit interfaces is preferable, and is expressly identified in MIL-STD-1316F. However, one skilled in the art could substitute differential circuit interfaces or even encoded serial interfaces. In some other embodiments, the arming sensors are implemented using simple binary switches, such as salinity, external water pressure, and targeting enable.

The sensing systems mentioned above can be used as follows in conjunction with the safe and arm system.

After energizing the UUV, it is immersed in water. Electrical conductivity sensor 854 (of hull monitoring subsystem 852), which is positioned along the hull of the UUV, is able to sense the conductivity of the water. This conductivity will, of course, be very different when the UUV is in air (e.g., stored on a vessel waiting for deployment, etc.) versus when it is in water. When a processor associated with hull subsystem 852 determines, from the sensor readings, that the conductivity requirement has been met, it sends a signal indicative thereof (water-immersion inhibit-removal condition 890A) to controller 850.

Pressure sensor 858 (of depth measuring subsystem 856) at the hull of the UUV obtains a reading indicative of the depth of the UUV in the water. When a processor associated with depth-measuring subsystem 856 determines that the UUV is submerged to a depth that meets and/or exceeds some target depth, it sends of signal indicative thereof (ocean-depth inhibit-removal condition 892A) to controller 850.

In some embodiments, in conjunction with targeting subsystem 862, target recognition is performed by a human; in some other embodiments, it is performed via artificial intelligence. If a human is monitoring a sonar image from sonar 864 and a camera image from camera 866, the human must trigger the remove-inhibit condition (signal). This condition can be relayed via a tether cable to the UUV, wherein the remove-inhibit signal is received by controller 850. If a machine learning (ML)/artificial intelligence (AI) algorithm running in the UUV is monitoring sonar 864 and camera 866, the algorithm must trigger the remove inhibit condition to cause a signal indicative thereof (target-identification inhibit-removal condition 894A) to be transmitted to controller 850.

Active sonar processing, via sonar 864, and LIDAR processing, via LIDAR 868 of targeting subsystem 862, can return a range to the target. The weapon on the UUV will have a maximum range, which decreases with increasing depth. For example, in some embodiments, sensor processing uses a pressure-sensor reading (e.g., from pressure sensor 854, etc.) to calculate the maximum allowable range of the cargo round, (e.g., via a table look-up, etc.), and then compare the processed sensor range-to-target to the calculated maximum range of the cargo round. The sonar or LIDAR processing must trigger the remove inhibit condition for "target within range" to cause a signal indicative thereof (target-range inhibit-removal condition 896A) to be transmitted to controller 850. Basic electrical-circuit design practice is to provide a return path for every single-ended signal; hence returns 890B, 892B, 894B, and 896B.

Figure 9:
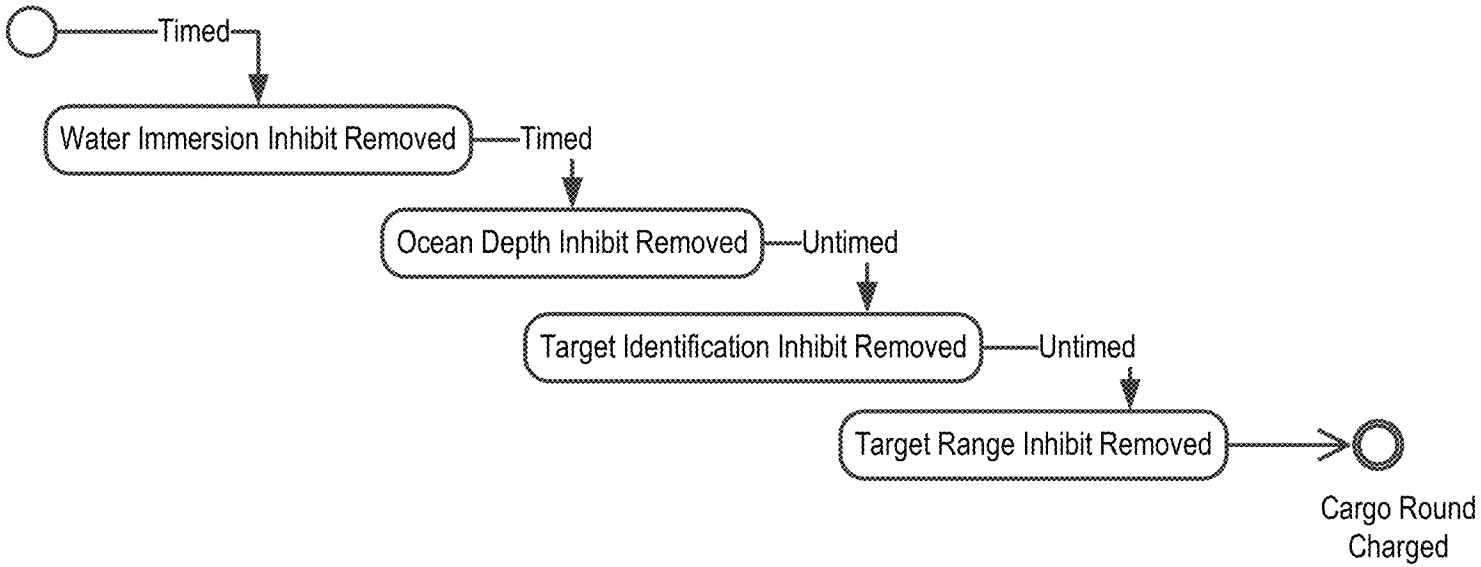
FIG. 9 depicts an example of a sequence of state transitions that can be used for the UUV sensor subsystems of FIG. 8.

Thus, all of the remove-inhibit conditions (signals) are monitored by the controller. With reference to FIG. 9, controller 850 uses the sensed conditions to transition through a sequence of "remove-inhibit" states. That is, the inhibit-remove conditions must be received in a specified order for the safety logic to initiate arming. Moreover, in some embodiments, controller 850 uses a timer to determine the amount of delay between the inhibit-remove conditions. For such embodiments, certain of the inhibit-remove conditions must occur within a minimum and maximum amount of delay from a previous condition. For example, in some embodiments, there will be a minimum and maximum time limit in which the controller must receive signal 890A indicating that the conductivity condition is met and/or a minimum and maximum time limit, following introduction into the water, in which controller receives signal 892A indicating that the depth requirement is met. Neither target identification nor target range conditions are likely to have time limits.

Figure 10:
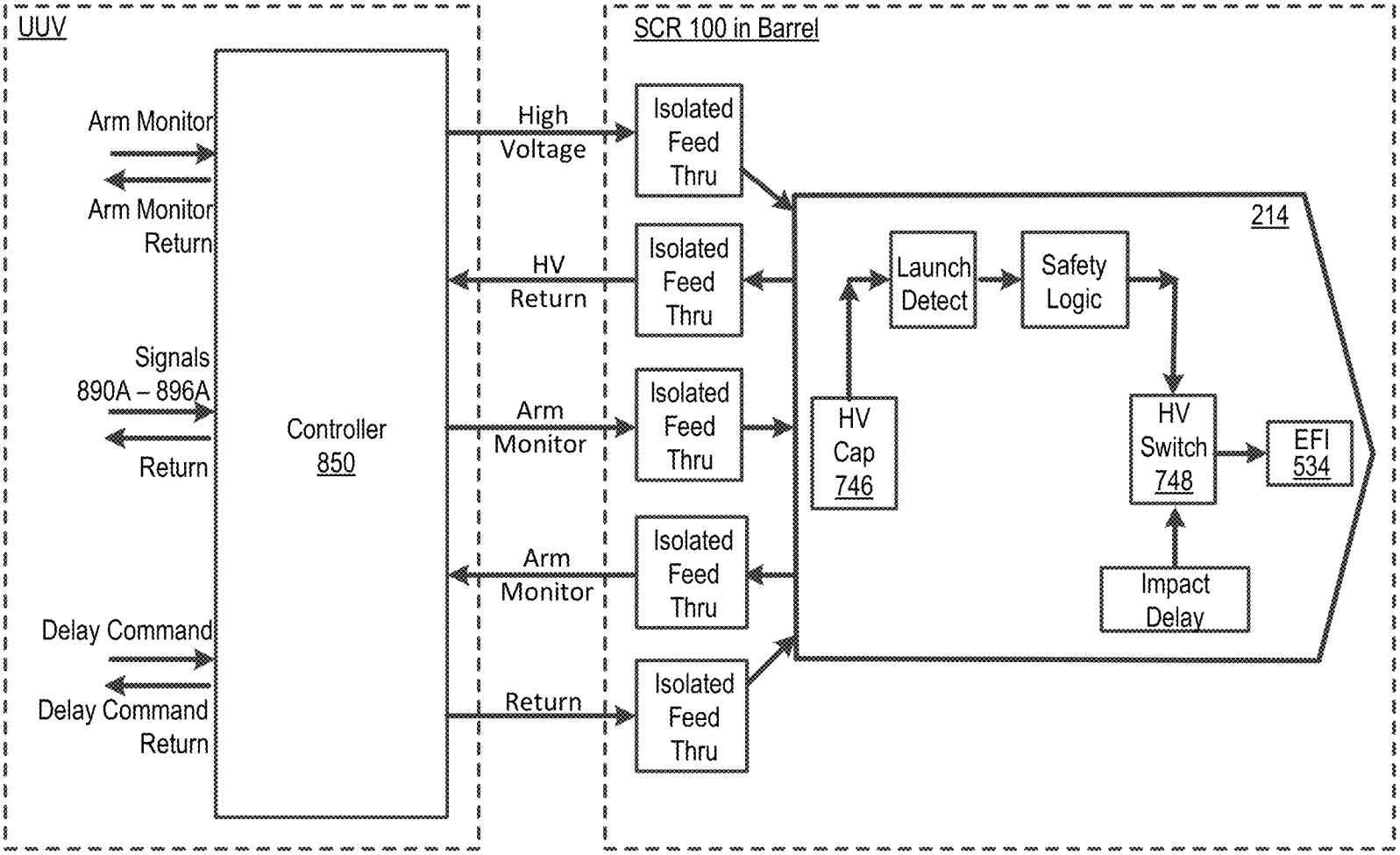
FIG. 10 depicts communications between the UUV and cargo round with respect to safe and arm operations in accordance with the present teachings.

FIG. 10 depicts how the UUV, the effector (i.e., the barrel of gun), and SCR 100 share safe-arm and fire electronics. On the left side of the Figure, controller 850 communicates with UUV-based sensors to prevent unintentional arming, as previously discussed.

With continuing reference to FIGS. 8-10, when the four inhibit-remove conditions/signals 890A through 896A are received in the proper order and in appropriate time limits, the safe and arm safety logic within controller 850 initiates a charging waveform with varying pulse rate and current amplitude over a specified time duration to fully charge HV capacitor 746 (FIG. 7) on ESAF 534. This is denoted by the "High Voltage" signal that is transmitted from controller 850 to ESAF 534. Note that the charging mechanism is part of controller 850 in the UUV, so SCR 100 cannot be fired (is not live) until all inhibit conditions are sequentially removed. This is an aspect of the safety provided by the safe and arm system.

Thus, outside-of-the-barrel arming conditions are relayed to ESAF 534 while SCR 100 is inside the barrel. The interface to ESAF 534 must be highly protected. The specific arming conditions being sensed are typically adjusted to the prevailing conditions (i.e., in the region in which the UUV is intended to operate), such as the UUV being within a maximum range and minimum range for the target. Yet, specific sensed values and timing constraints must remain isolated or hidden. In accordance with the present teachings, passing the high voltage from controller 850 to the ESAF 534 to charge HV capacitor 746 is a way to meet the requirements for relaying the "message" that the outside-of-the-barrel arming conditions are met.

In the illustrative embodiment, the system utilizes partitioning to provide additional safety. The primary interface is between the UUV and the safe and arm control, and provides mission identification. This information is known to the UUV, but not to SCR 100. A dependent interface, which is between the UUV and SCR 100, provides triggering acceleration values and delays. In this manner, different sensor conditions can be used to meet different mission objectives, thereby providing additional safety without exposing the interfaces to the fuze. (The term "ESAF" and "fuze" are used interchangeably herein.) Programming information intended for ESAF 534 is digitally encoded at controller 850, and then transmitted therefrom to ESAF 534 as electrically modulated pulses over the "High Voltage" connection.

Arming SCR 100 requires that certain environmental conditions have been met, as discussed above. However, additional conditions must be satisfied in the fuze before energetic payload 212 is initiated. For example, energetic payload 212 should not be initiated while SCR 100 is in the barrel of the weapon. Consequently, after charging HV capacitor 746, sensors within ESAF 534 continuously monitor armed SCR 100 while it is in the barrel's breech. When the controller requests the arm-monitor status of SCR 100, controller 850 drives current and voltage across the "Arm Monitor" line to SCR 100. ESAF 534 responds to controller 850 with the arm-monitor status by driving current and voltage across the reverse-directioned "Arm Monitor" line.

Thus, SCR 100 remains in the barrel until targeting subsystem 862 triggers and fires the propellant in the breech of the barrel. During this waiting interval, controller 850 monitors the armed state of ESAF 534.

After SCR 100 is fired, the aforementioned monitoring signal is lost since there is no longer an electrical connection between controller 850 and SCR 100. One or more accelerometers in ESAF 534 obtain time-critical measurements of acceleration along the barrel. These measurements occur during the first two inches of travel in the barrel, which is when the peak g-load of about 3000 g during launch is experienced. A first g-switch with a target g-load of 3000 g triggers assuming the aforementioned peak g-load is experienced.

In some embodiments, in addition to lifting the four inhibit signals as previously discussed, "arming" also requires severing the electrical connection to SCR 100 and triggering the first g-switch. This provides an extra measure of safety and repeatedly. Specifically, in the absence of having to satisfy these additional conditions, if the electrical signal between controller 850 and ESAF 534 is lost prior to firing, LCR 100 could potentially detonate in the barrel. Thus, in some embodiments, SCR 100 is not armed until the electrical condition to SCR 100 is severed and the first g-switch is triggered.

Once SCR 100 is armed, an 8 millisecond "blanking" or "no fire" window is initiated. During this window, the energetic payload in SCR 100 cannot be initiated. This ensures that SCR 100 an amount of time necessary to exit the barrel's muzzle and travel into the water a short distance before the energetic payload can be initiated.

In some embodiments, after satisfying all those conditions (i.e., lifting the four inhibits, severing electrical connection, triggering the first g-switch), ESAF 534 waits for a second g-switch to trigger, which initiates energetic payload 212. The second g-switch triggers on "terminal" ballistic impact with a target. SCR 100 will experience a very high g-load on such terminal ballistic impact; g-loads in excess of 100,000 g can be experienced. This second, higher g-load must be measured by the second g-switch as a condition precedent to initiating energetic payload 212.

After the 8-millisecond delay, an independent "sterilization" timer in ESAF 534 initiates. If a minimum g-load is not measured by the second g-switch (no impact with target), the energetic payload 212 cannot be triggered, yet LCR 100 is armed. The sterilization timer detonates SCR 100 within a preset time, preventing runaway live rounds that fail to detonate on the target. Alternatively, the charge on HV capacitor 746 will dissipate within a few minutes, such that SCR 100 de-arm, such that a "safety" detonation is not required.

Assuming the SCR 100 fires with an expected velocity, it will be traveling at about 1500-3000 feet/sec as it leaves the barrel and enters the water. Consequently, SCR 100 will experience a significant g-load (c.a. 2000-3000 g). It is important that the second g-switch does not trigger on water penetration. Presently available g-switches suitably sized for use in conjunction with the illustrative embodiment have a maximum target g-load value of about 5000 g. Thus, a second g-switch with a target g-load of about 5000 g should be able to reliably distinguish between "water" impact and "target" impact.

When the g-load measured by the second g-switch indicates terminal ballistic impact, HV switch 748 is enabled by circuitry 744 of ESAF 534. Enabling HV switch 748 causes the high-voltage energy stored in HV capacitor 746 to discharge to Exploding Foil Initiator (EFI) 536. EFI 536 initiates detonation of energetic payload 212, through digital-delay timer circuits and discrete logic circuits of ESAF 534.

Setting a delay in the fuze timer enables target penetration prior to detonation. The timer is reprogrammable during the mission any time prior to firing SCR 100. For example, by adjusting its delay, the timer enables the projectile to engage underwater threats having differing casing materials, casing thicknesses, and air gap. The air gap is an important consideration, because the targets being penetrated can have ballast tanks, buoyancy devices, or a deliberate design element to throw off the fuze's sensing behavior. The programmability of ESAF 534 thus provides mission versatility.

Thus, upon impact with, for example, the outer casing of a target, ESAF 534 initiates the aforementioned digital-delay timer, giving SCR 100 time to penetrate the target's outer casing and embed energetic payload 212 in the target. At expiration of the delay, EFI 536 fires, which detonates energetic payload 212 and destroys the target.

There are certain unique forces that only occur during supercavitating conditions. The present inventors recognized that such forces can serve as a unique set of arming conditions for SCR 100.

In accordance with some embodiments, either the aforementioned g-switches, or one or more additional accelerometers, can be used to sense conditions that are characteristic of supercavitating transit; in particular: (1) supercavitating hydrodynamic drag, and (2) periodic water/cavity interactions. These two conditions can be used, in conjunction with other types of measurable behavior of SCR 100, to determine the status of SCR 100 once fired.

The tip of the nose (the cavitator) of an SCR during water penetration produces a water-vapor cavity that entirely encloses the SCR during supercavitating transit. The drag load produced by the cavitator varies with speed and water depth, which can be measured to estimate its underwater trajectory. Similarly, SCR water/cavity interactions produce distinctive periodic patterns that one skilled in the art can use to estimate the speed and resulting underwater trajectory of the SCR.

Table I below shows various fuze-sensing conditions that can occur during firing, transit, and impact of an SCR with a target.

TABLE I

Fuze-Sensing Conditions

| Fuze Sensing Condition | Comment |
|---|---|
| Barrel Acceleration | Conventional sensing of acceleration. |
| Supercavitating Hydrodynamic Drag | Conventional sensing of "no" acceleration past the muzzle. |
| Deceleration | Sensing of supercavitating drag as SCR 100 passes through the cavity created by the firing thereof. |
| First Terminal Ballistic Impact | A thin target hull will not significantly impede SCR 100. |
| Second Exiting Terminal Ballistic Impact | This occurs if SCR 100 passes through the target. |
| Resume supercavitating | This occurs if SCR 100 maintains sufficient velocity after passing through the target. |
| SCR 100 tumbles | This occurs if the cavity collapses. |

A supercavitating round, such as SCR 100, tends to pitch and/or roll within the vapor cavity that it creates in the water. SCR 100 is designed to provide correcting angular "jerks" when it contacts the edge of the cavity; that is, the interface of the water and the water vapor. Such water/cavity interactions are normal during supercavitation. However, chaotic tumbling is not normal, and if accelerometer measurements indicate chaotic tumbling, this means that the cavity has collapsed onto the body of the round.

Terminal ballistic deceleration will be orders of magnitude greater than the supercavitating hydrodynamic drag prior to impact, and will reduce the SCR's velocity from about 2000-3000 feet per second (fps) to approximately 200 fps in 0.0003 seconds for a steel plate having a thickness of 1.5 inches. A key variable is the terminal ballistic velocity of SCR 100, which declines over time-of-transit (to target) due to the supercavitating hydrodynamic drag of the blunt nose of the round. The time of transit is usually milliseconds.

In accordance with some embodiments, supercavitating hydrodynamic drag, water-cavity interactions, chaotic tumbling, and terminal ballistic deceleration are used to identify the status of an SCR, such as SCR 100, after firing. The manner in which these characteristic conditions/movements can be used to assess status is shown below in Table II.

TABLE II

Status of a SCR Capable of Being Sensed by the Fuze

| | Status of the SCR | Analysis by Fuze |
|---|---|---|
| 1 | The SCR misses the target. | The fuze can identify this state because of the long-duration transit followed by chaotic tumbling and a lack of terminal ballistic deceleration. |
| 2 | The SCR deflects off the target. | The fuze can recognize this state because of the hydrodynamic drag transit followed pitch/yaw jerks (i.e., water cavity interactions), followed by hydrodynamic drag transit followed by chaotic tumbling, and a lack of the complete terminal ballistic deceleration. |
| 3 | The SCR hits the target off-center. | The fuze can recognize this state because of the hydro drag transit followed pitch/yaw jerks, and terminal ballistic deceleration without chaotic tumbling. |

TABLE II-continued

| Status of a SCR Capable of Being Sensed by the Fuze | | |
|---|---|---|
| | Status of the SCR | Analysis by Fuze |
| 4 | The SCR bulls-eyes the target. | The fuze can recognize this state because of the hydro drag transit followed by terminal ballistic deceleration without pitch/yaw jerks or chaotic tumbling. |
| 5 | The SCR hits and passes through the target. | The fuze can recognize this state because of the hydro drag transit followed by a first ballistic deceleration followed by a second ballistic deceleration followed by hydro drag transit or chaotic tumbling. |
| 6 | The SCR was inadvertently fired in air. | The fuze can recognize this state because of the lack of hydro drag transit. |

The status of SCR 100, determined as discussed above, can be used for a variety of purposes. As previously indicated, SCR 100 can experience a g-load of 100,000 g or more upon terminal ballistic deceleration with a target. If, however, SCR 100 passes through a target, depending on the target's thickness and materials of construction, the g-load might be significantly less than for terminal ballistic deceleration, say 20,000 to 50,000 g. If the second g-switch has a target g-load of say 6,000 g, it would, under such circumstances, trigger energetic payload 212, even though SCR 100 has not embedded in a target. The aforementioned characteristic motions/behaviors can thus be used to supplement/validate the decision (based on the measurement from the second g-switch) to trigger energetic payload 212.

As previously noted, when SCR 100 enters the water, the g load on deceleration is in the range of about 2000 to 3000 g at a zero-degree angle of attack. However, when SCR 100 starts pitching in the water-vapor cavity and interacting with the water/vapor interface, the g load can increase to over 10,000 g. Once again, if the second g-switch has a target g-load of 5,000 to 6,000 g, it would, under such circumstances, trigger energetic payload 212, even though SCR 100 has not embedded in a target.

Furthermore, the aforementioned characteristic motions/behaviors can be used as an alternative to using the sterilization timer. For example, in some embodiments, when ESAF 534 determines that the status of SCR 100 is any one of 1, 2, 5, or 6 above, safety logic causes SCR 100 to detonate.

It is to be understood that the disclosure describes a few embodiments and that many variations of the invention can easily be devised by those skilled in the art after reading this disclosure and that the scope of the present invention is to be determined by the following claims.

What is claimed:

1. A method for implementing an electronic safe-arm and fire system for use with a supercavitating cargo round (SCR) that is fired from a barrel of a weapon, the method comprising:

temporarily electrically coupling a controller to an electronic safe-arm and fire device (ESAF) disposed in the SCR, wherein the controller is external to the barrel;

receiving, at the controller, a plurality of inhibit-remove signals from a plurality of sensor systems that are disposed external to the barrel;

after receiving the inhibit-remove signals, generating, by the controller, a high-voltage signal that charges a high-voltage capacitor of the ESAF;

assessing a status of the SCR by:

a) determining if the electrical coupling between the controller and the ESAF is severed;

b) measuring a first g-load within the barrel, the first g-load indicative of whether the SCR has attained an acceptable velocity; and c) measuring a second g-load after the SCR has exited the barrel, wherein, as a function of the value of the second g-load, target impact is detected or not detected; and triggering or not triggering an energetic payload in the SCR based on the assessed status.

2. The method of claim 1, and wherein assessing the status of the fired SCR further comprises identifying characteristics of supercavitating transit of the SCR, or the absence thereof, and a sequence in which the supercavitating-transit characteristics occur or do not occur in relation to one or more characteristics selected from the group consisting of ballistic deceleration and chaotic tumbling.

3. The method of claim 2 wherein identifying the characteristics of supercavitating transit of the SCR further comprises using accelerometers and logic circuitry in the ESAF.

4. The method of claim 1 wherein each one of the plurality of sensor systems transits a respective inhibit-remove signal when an environmental condition monitored thereby is satisfied.

5. The method of claim 4 wherein two inhibit-remove signals are transmitted indicating that two environmental conditions are satisfied, and wherein the two environmental conditions are selected from the group consisting of a specified value of an electrical conductivity of the SCR's environment, a minimum pressure of the SCR's environment, an identification of a target, and a range of the SCR to a target.

6. The method of claim 4 wherein four inhibit-remove signals are transmitted indicating that four environmental conditions are satisfied, and wherein the four environmental conditions are selected from the group consisting of a specified value of an electrical conductivity of the SCR's environment, a minimum pressure of the SCR's environment, an identification of a target, and a range of the SCR to a target.

7. The method of claim 1 wherein receiving the plurality of inhibit-remove signals further comprises verifying that the plurality of inhibit-remove signals are received in a specified order, such that the high-voltage signal is generated only upon said verifying.

8. The method of claim 7 further comprising assessing a time delay at which at least some of the plurality of inhibit-remove signals are received with respect to one another.

9. The method of claim 8 further comprising verifying that the assessed time delays are within a minimum and maximum range, such that the high-voltage signal is generated upon said verifying.

10. The method of claim 1 further comprising firing the SCR underwater.

* * * * *